US009144336B2

(12) United States Patent
Hammi

(10) Patent No.: US 9,144,336 B2
(45) Date of Patent: Sep. 29, 2015

(54) PROTECTIVE SPOUT COVER WITH FOOD REGULATING VALVE

(71) Applicant: Choomee, Inc., San Diego, CA (US)

(72) Inventor: Julie Hammi, Park City, UT (US)

(73) Assignee: Choomee, Inc., San Diego, CA (US)

( * ) Notice: Subject to any disclaimer, the term of this patent is extended or adjusted under 35 U.S.C. 154(b) by 0 days.

(21) Appl. No.: 14/486,745

(22) Filed: Sep. 15, 2014

(65) Prior Publication Data

US 2015/0076178 A1 Mar. 19, 2015

Related U.S. Application Data

(63) Continuation of application No. 14/031,875, filed on Sep. 19, 2013, now Pat. No. 8,833,598.

(60) Provisional application No. 61/702,778, filed on Sep. 19, 2012.

(51) Int. Cl.
*A47G 19/22* (2006.01)

(52) U.S. Cl.
CPC ..... *A47G 19/2266* (2013.01); *A47G 19/22* (2013.01); *A47G 19/2272* (2013.01)

(58) Field of Classification Search
CPC ..... A47G 19/2272; A47G 19/2266; A47G 19/2205; A61J 11/002; A61J 11/0015; A61J 11/001; A61J 11/0085; A61J 11/008; A61J 11/0075; B65D 51/165; B65D 51/1644; B65D 51/1633; B65D 47/121; B65D 47/122; B65D 47/12; B65D 47/06; B65D 33/008; B65D 75/008; B65D 81/3888
USPC ..... 220/254.1, 212, 714, 713, 711, 724, 220/203.19, 203.27, 203.29, 203.16, 220/203.11, 203.01, 803, 802, 801, 800, 220/797, 796; 215/311, 307, 11.4, 11.1; 222/545, 547, 562
See application file for complete search history.

(56) References Cited

U.S. PATENT DOCUMENTS

| | | | | |
|---|---|---|---|---|
| 2,039,373 A | | 5/1936 | Wittmann | |
| 2,589,206 A | * | 3/1952 | Tegarty | 222/553 |
| 2,969,167 A | | 1/1961 | Libit | |

(Continued)

OTHER PUBLICATIONS

Nuk USA, LLC, Website, Pouch Feeding Straw, Copyright 2013, http://www.nuk-usa.com/gerber/6-12months/new2013/pouch-feeding-straw.aspx.

(Continued)

*Primary Examiner* — Robert J Hicks
(74) *Attorney, Agent, or Firm* — Schwabe, Williamson & Wyatt, P.C.

(57) ABSTRACT

Provided herein are protective spout covers adapted to couple to the universal dispensing spout of a food pouch, such as a baby food pouch. The protective spout covers may be formed from a flexible elastomer and may grip the spout securely via one or more gripping lips adapted to engage a corresponding groove on the universal spout. When so coupled, the protective spout cover may cushion the spout to protect the user's mouth and lips from injury. The protective spout cover also may include a food regulating valve that may control the flow of food from the pouch. The protective spout cover also may include a cap member to keep the protective spout cover clean when not in use, a gripping ring to facilitate use of the cap, and may have a size and durometer hardness sufficient to prevent the device from being a choking hazard.

20 Claims, 7 Drawing Sheets

(56) References Cited

U.S. PATENT DOCUMENTS

| | | | |
|---|---|---|---|
| 3,207,349 | A | 9/1965 | Rabe |
| 2011/0151069 | A1 | 6/2011 | Harding |

OTHER PUBLICATIONS

PouchPop TM Reusable Baby Food Pouches, Website, Baby Feeding Products PouchPop Assorted 4-Pack, http://www/pouchpop.com/products/, Mar. 2, 2013.

* cited by examiner

PROTECTIVE SPOUT COVER WITH FOOD REGULATING VALVE

CROSS REFERENCE TO RELATED APPLICATIONS

The present application claims priority to U.S. Patent Application No. 61/702,778, filed Sep. 19, 2012, entitled "PROTECTIVE FOOD REGULATING VALVE," and U.S. patent application Ser. No. 14/031,875, entitled "PROTECTIVE SPOUT COVER WITH FOOD REGULATING VALVE," filed Sep. 19, 2013, the disclosures of which are hereby incorporated by reference in their entirety.

TECHNICAL FIELD

Embodiments relate to the field of protective devices for feeding infants and children from food pouches, and more particularly to protective food pouch spout covers that include a food regulating valve.

BACKGROUND

Many baby food products now offer blended meals in a relatively flexible pouch. For busy families, this is a convenient method for providing healthy, creative flavor combinations ideal for young developing palates. However, the universal dispensing spout used with such baby food products may be problematic for various reasons. For instance, the universal dispensing spout features a wide diameter, intended for "easy-flow" of the food products contained therein. However, young children have limited motor skills and typically cannot manipulate pressure on the pouch accurately enough to avoid spilling its contents. Additionally, accidentally dropping the pouch may cause spills, creating messes and wasting necessary calories, nutrients, and money.

The universal dispensing spout also features a rigid structure with sharp corners, which structure is necessary for the food-filling process and to ensure the safety of the pouch contents. However, the target age group for pouch foods is curious, and often teething, and therefore they naturally love to feel, taste, and chew on the pouch spout, in addition to the pouch contents. Biting the spout can be tremendously painful for infants and young children, causing lacerations to their tongue, gums, or lips. Such injuries are discouraging for both baby and parent because transitioning to real food from milk or formula should be a positive milestone, not a painful one.

BRIEF DESCRIPTION OF THE DRAWINGS

Embodiments will be readily understood by the following detailed description in conjunction with the accompanying drawings. To facilitate this description, like reference numerals designate like structural elements. Embodiments are illustrated by way of example and not by way of limitation in the figures of the accompanying drawings.

DETAILED DESCRIPTION

Figure 1:
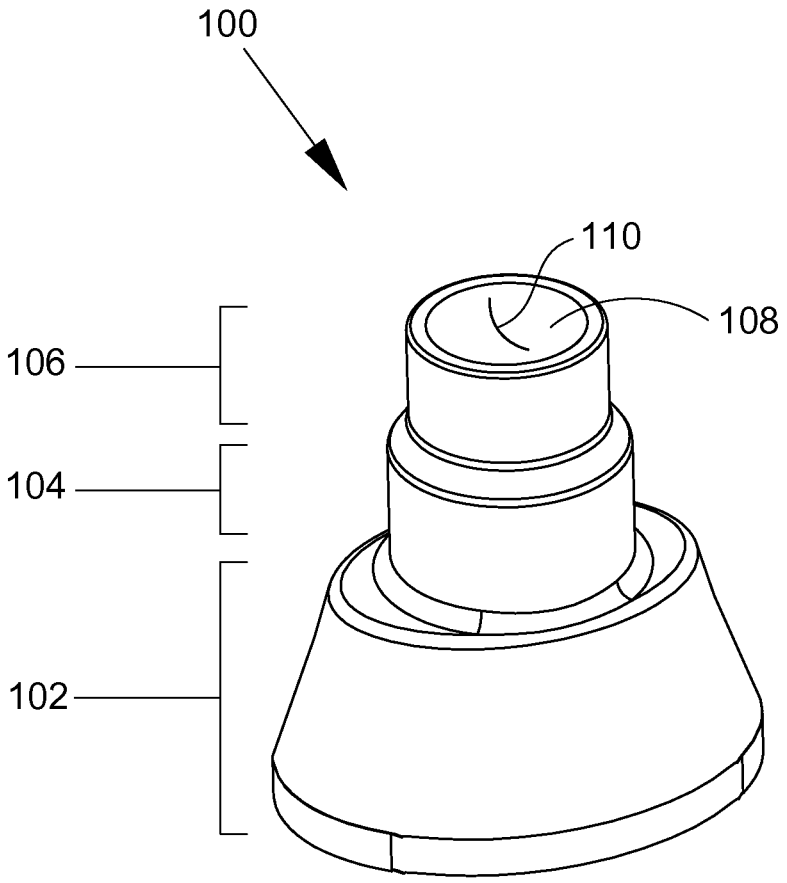
FIG. 1 is a perspective view of one example of a protective spout cover for a food pouch, in accordance with various embodiments.

In the following detailed description, reference is made to the accompanying drawings which form a part hereof wherein like numerals designate like parts throughout, and in which is shown by way of illustration embodiments in which the disclosure may be practiced. It is to be understood that other embodiments may be utilized and structural or logical changes may be made without departing from the scope of the present disclosure. Therefore, the following detailed description is not to be taken in a limiting sense, and the scope of embodiments in accordance with the present disclosure is defined by the appended claims and their equivalents.

Various operations may be described as multiple discrete operations in turn, in a manner that may be helpful in understanding embodiments of the present disclosure; however, the order of description should not be construed to imply that these operations are order dependent.

The description may use perspective-based descriptions such as up/down, back/front, and top/bottom. Such descriptions are merely used to facilitate the discussion and are not intended to restrict the application of embodiments of the present disclosure.

For the purposes of the present disclosure, the phrase "A/B" means A or B. For the purposes of the present disclosure, the phrase "A and/or B" means "(A), (B), or (A and B)". For the purposes of the present disclosure, the phrase "at least one of A, B, and C" means "(A), (B), (C), (A and B), (A and C), (B and C), or (A, B and C)". For the purposes of the present disclosure, the phrase "(A)B" means "(B) or (AB)" that is, A is an optional element.

The description may use the phrases "in an embodiment," or "in embodiments," which may each refer to one or more of the same or different embodiments. Furthermore, the terms "comprising," "including," "having," and the like, as used with respect to embodiments of the present disclosure, are synonymous.

Embodiments provide protective spout covers adapted to couple to the universal dispensing spout of a food pouch, such as a baby food pouch. In various embodiments, the disclosed protective spout covers may be formed from a flexible elastomer, such as silicone or a silicone-based elastomer, and may be configured to grip the spout securely and cushion the spout to protect the user's mouth and lips from injury. In various embodiments, the protective spout cover may include a food regulating valve that may be configured to control the flow of food from the pouch, for instance, to prevent accidental spills. Some embodiments also may include a cap member to keep the protective spout cover clean when not in use.

In various embodiments, the protective spout cover may include different portions having different functions. For instance, in some embodiments, the protective spout cover may include a spout cushioning portion that provides protective cushioning about the spout while also producing an airtight seal with the pouch, a lower gripping portion with an internal gripping system that includes internal receiving grooves and/or gripping lips that interlock with corresponding features on the pouch spout, and an upper valve portion that projects beyond the tip of the universal spout and includes a valve. In various embodiments, the upper valve portion may include a top membrane having a valve aperture for controlling the flow of food (or other pouch contents) from the pouch.

In various embodiments, the top membrane may have a concave surface, and in various embodiments the valve aperture may have any of several configurations, such as a transverse orientation, a longitudinal orientation, or it may include both transverse and longitudinal elements. Some embodiments of the protective spout cover also may include a cap member that may couple to and cover the protective spout cover, and in some embodiments, the cap member may be tethered to the protective spout cover via a flexible connector, and/or may include a gripping ring or other gripping feature. In various embodiments, the protective spout cover, including the flexible connector, cap member, and gripping ring, if present, may be formed from a single piece of elastomer and may include no detachable parts that could pose a choking hazard.

Thus, in various embodiments, a protective spout cover may be configured for sealing engagement with a universal spout on a food pouch, and it may include a unitary elastomeric member having an upper end, a lower end, and a sidewall defining a generally cylindrical lumen extending therethrough. As discussed above, the sidewall of the protective spout cover may include several distinct portions, such as a gripping portion disposed adjacent the lower end, a valve portion disposed adjacent the upper end, and a spout cushioning portion disposed between the gripping portion and the spout cushioning portion. In various embodiments, each of these sidewall portions also may have a different thickness. The thickness of the different sidewall portions, in concert with the overall durometer hardness of the silicone or silicone based polymer, may function to prevent the protective spout cover from flexing or folding upon itself, either when coupled to a spout or when uncoupled. In various embodiments, this minimal rigidity or hardness may help to prevent undesirable flexibility in the device, which could cause a choking hazard, as described more fully below.

As described above, each portion of the protective spout cover may perform a different function. For example, in some embodiments, the valve portion may include a valve configured to control the flow of food from the food pouch. The sidewall of the lower gripping portion may be sized and shaped to receive and grip an exterior surface of the universal spout, and it may include an interior surface having an inward-projecting gripping lip adapted to engage and grip a corresponding groove on the exterior surface of the universal spout. Additionally, in various embodiments, the spout cushioning portion may include a second sidewall portion configured to sealingly engage an exterior surface of the universal spout.

Turning now to the Figures, FIG. 1 is a perspective view of one example of a protective spout cover for a food pouch, in accordance with various embodiments. As illustrated, in various embodiments, the protective spout cover 100 may include a lower gripping portion 102 that is configured to selectively and securely grip one or more exterior features on a universal spout for a baby food pouch, such as a protrusion, ridge, lip, or groove. In various embodiments, protective spout cover 100 also may include a spout cushioning portion 104, as illustrated, that may surround and cushion the hard walls and potentially sharp edges of the universal spout, for instance to protect the lips, tongue, and/or gums of a child or infant who receives the contents of the baby food pouch or the like. In various embodiments, spout cushioning portion 104 may have an internal diameter that is sufficiently large to stretch about the outer diameter of a universal spout, but still small enough to grip the external surface of the universal spout tightly and prevent food leakage from the pouch. Some embodiments also may include an upper valve portion 106 that projects beyond the tip of the universal spout. In various embodiments, upper valve portion may have a smaller outer diameter than spout cushioning portion 104, and may provide a cushioned air/food chamber that may be in direct contact with the mouth of the user, enhancing comfort. In various embodiments, the projection of upper valve portion 106 beyond the tip of the universal spout may help improve control of food flow through the valve.

As shown in FIG. 1, upper valve portion 106 may include a top membrane 108, which, in some embodiments, may have a concave surface that may facilitate the inclusion and operation of a valve having a valve aperture 110. Valve aperture 110 may be configured to selectively open, for instance, in response to suction from a child's mouth or from external pressure on the food pouch, and may be configured to limit the speed with which food may pass through valve aperture 110. One of skill in the art will appreciate that although valve aperture 110 is illustrated as having a particular size and orientation, various features of valve aperture 110 may be changed as described in greater detail below in order to optimize the operation of the valve, for example, for a particular food viscosity, a particular developmental stage, or the age of the child.

Figure 2:
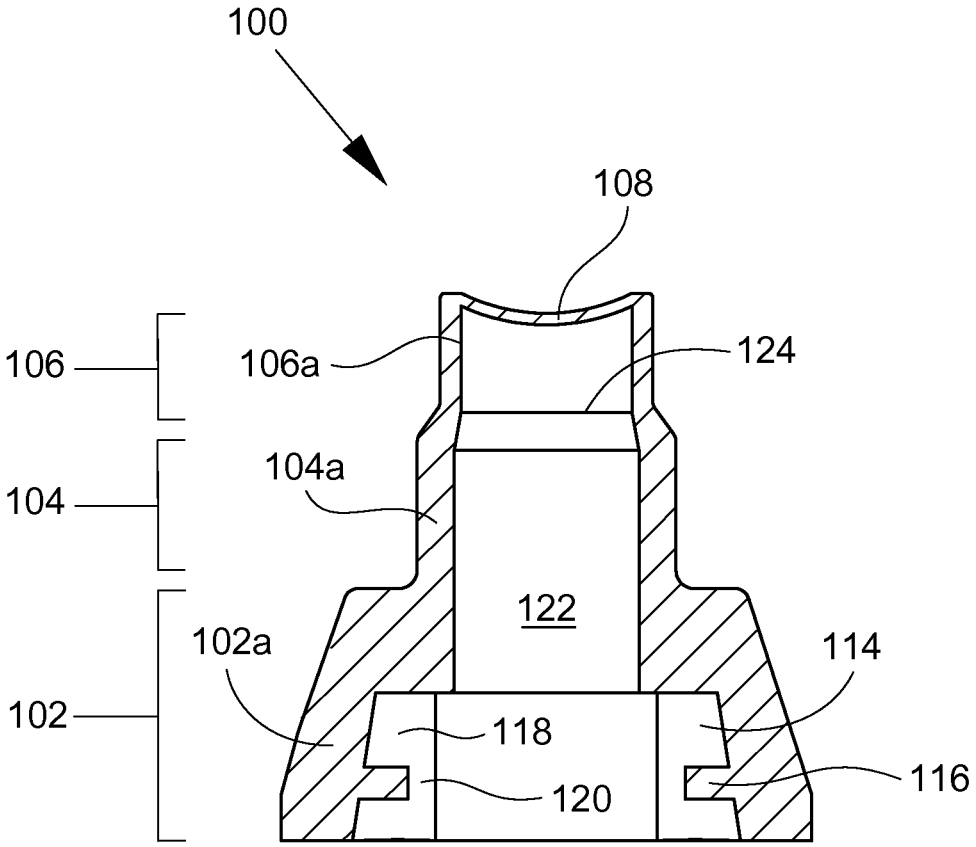
FIG. 2 is a cross-sectional side view of the protective spout cover shown in FIG. 1, in accordance with various embodiments.

FIG. 2 is a cross-sectional side view of the protective spout cover 100 of FIG. 1, shown mounted on a universal spout 122. As can be seen in FIG. 2, protective spout cover 100 includes a spout cushioning portion 104 that surrounds and cushions universal spout 122. In various embodiments, spout cushioning portion 104 may include a specific inner diameter selected to stretch over the outer diameter of universal spout 122, while also tightly gripping the exterior surface of universal spout 122. Additionally, spout cushioning portion 104 may include a sidewall **104*a* having a thickness, density, or durometer hardness sufficient to provide ample cushioning to universal spout 122, while also being sufficiently strong to withstand repeated compression by teeth and to prevent accidental removal of or disconnect from the universal spout. For example, in some embodiments, sidewall 104*a*** may have a thickness ranging from about 0.6 mm to about 10 mm, for example, about 1, 2, or 3 mm, and a durometer hardness of from about 50 to about 80 Shore A, for example, about, 50, 55, or 60 Shore A.

In various embodiments, protective spout cover 100 also may include an upper valve portion 106 that projects beyond the tip 124 of universal spout 122 and provides room for top membrane 108, which structure includes a valve (not shown). In various embodiments, upper valve portion 106 may include a sidewall 106*a* having a thickness, density, or durometer hardness sufficient to provide a desired amount of support and flexibility for the valve, and may have a different thickness, density, or durometer hardness than sidewall 104*a* of spout cushioning portion 104. For example, in some embodiments, sidewall 106*a* may have a thickness ranging from about 0.6 mm to about 6 mm, for example, about 1.1 mm, and, as with other portions of the protective spout cover, it may have a durometer hardness of about 50 to about 80 Shore A, for example, about 50, 55, or 60 Shore A.

As further illustrated in FIG. 2, protective spout cover 100 also may include a lower gripping portion 102 that extends along the base of universal spout 122 and securely and selectively grips universal spout 122. In various embodiments, lower gripping portion 102 may include a sidewall 102*a* having a thickness, density, or durometer hardness sufficient to provide a secure grip on universal spout 122, preventing food leakage between the outer surface of the spout and the inner surface of the protective spout cover. In various embodiments, sidewall 102*a* may have a different thickness, density, or durometer hardness than sidewalls 104*a* and/or 106*a*. For example, in some embodiments, sidewall 102*a* of lower gripping portion 102 may have a thickness ranging from about 3 mm to about 30 mm, for example, about 4, 5, 6, or 7 mm, and, as with other portions of the protective spout cover, it may have a durometer hardness of about 50 to about 80 Shore A, for example, about 50, 55, or 60 Shore A. Additionally, the thickness and durometer hardness of sidewall 102*a* may be selected to cause protective spout cover 100 to retain its shape when not coupled to a universal spout, thus ensuring that protective spout member 100 cannot fold or compress, which might cause it to be a choking hazard. Because of this rigidity or firmness, in some embodiments, the protective spout cover is not compressible to a size that could pose a choking hazard, which for the purpose of the present disclosure is defined as an object that could fit through a tube having a diameter of 1.25 inches and a length of between 1 and 2.25 inches.

In various embodiments, lower gripping portion 102 also may include one or more gripping features, such as groove 114 and one or more inner gripping lips 116 that are configured to mate with corresponding features on universal spout 122, such as spout lip 118 and/or spout groove 120. For instance, in some embodiments, inner gripping lip 116, which may be a complete annular ring, two or more portions of an annular ring, or any other projection extending inward from sidewall 102*a*, may be sized and shaped to snap over spout lip 118 and come to rest in spout groove 120, thus firmly coupling protective spout cover 100 to universal spout 122. Although only one groove 114 and inner gripping lip 116 are illustrated, one of skill in the art will appreciate that additional lips and grooves may be included if desired.

In various embodiments, inner gripping lip 116 may have a sufficient size and/or durometer hardness to retain protective spout cover 100 on universal spout 122 during use, which use often will include being pulled on or chewed on by a teething child. For example, in some embodiments, inner gripping lip 116 may have a height ranging from about 0.3 mm to about 5 mm, for example, 2 or 3 mm, it may project inward from sidewall 102*a* about from about 1 mm to about 6 mm, for example, 2 or 3 mm, and it may have a durometer hardness of about 50 to about 80 Shore A, for example, about 50, 55, or 60 Shore A. Furthermore, in various embodiments, sidewall 102*a* may be of sufficient thickness and/or durometer hardness to support and retain inner gripping lip 116 tightly in spout groove 120 such that tugging and biting by a child or infant is insufficient to dislodge protective spout cover 100 from universal spout 122. For example, several pounds per square inch of pressure may need to be applied to the protective spout cover in order to remove it from the universal spout, such as about 2, 3, 4, 5, or more pounds per square inch.

Figure 3A:
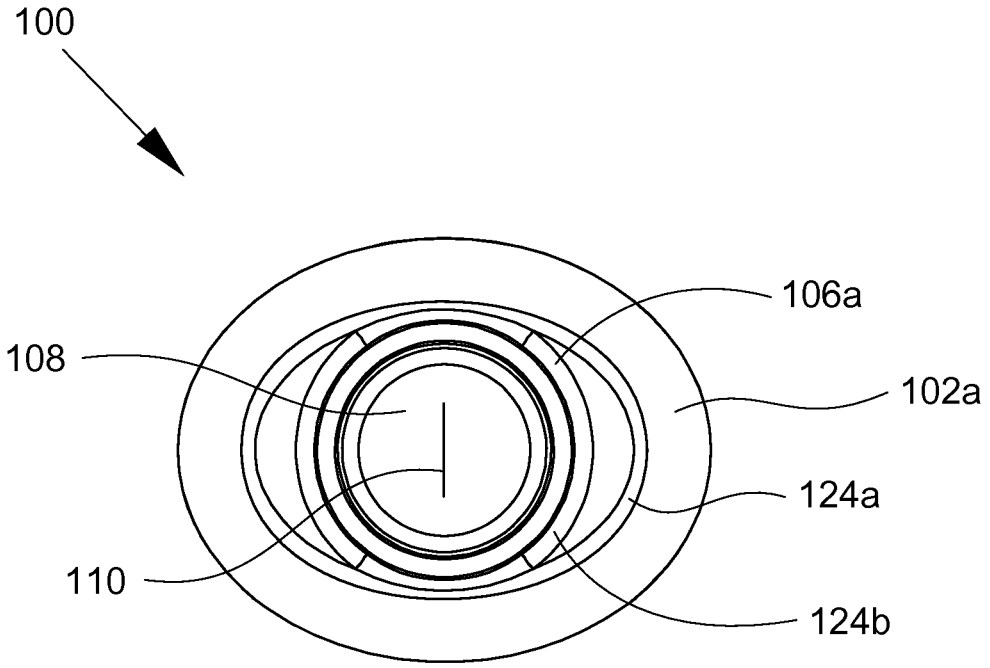
FIGS. 3A and 3B are planar top views of the protective spout cover shown in FIG. 1 (FIG. 3A), and a second example of a protective spout cover (FIG. 3B), in accordance with various embodiments.
Figure 3B:
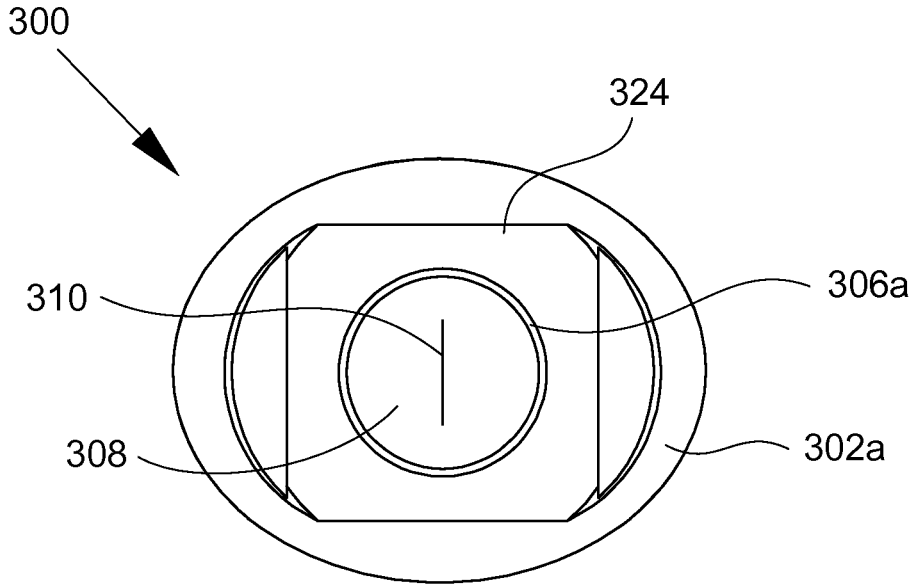

FIGS. 3A and 3B are planar top views of the protective spout cover shown in FIG. 1 (FIG. 3A), and a second example of a protective spout cover (FIG. 3B), in accordance with various embodiments. Whereas FIG. 3A illustrates a protective spout cover 100 having a series of circular steps 124*a* and oval steps 124*b* between sidewall 106*a* and sidewall 102*a*, FIG. 3B illustrates that the shape, size, and number of the steps may be varied. For example, the protective spout cover 300 shown in FIG. 3B includes a single, squared-off step 324 between sidewall 306*a* and sidewall 302*a*. Also see in both FIGS. 3A and 3B are top membranes 108, 308, and valve apertures 110, 310.

Figure 4A:
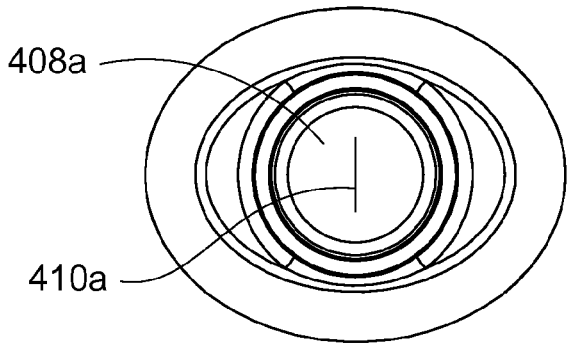
FIGS. 4A, 4B, and 4C are planar top views of three examples of protective spout covers having different regulating valve configurations, including a valve aperture having a transverse orientation (FIG. 4A), a valve aperture having a longitudinal orientation (FIG. 4B), and valve aperture having both transverse and longitudinal elements (FIG. 4C), in accordance with various embodiments.
Figure 4B:
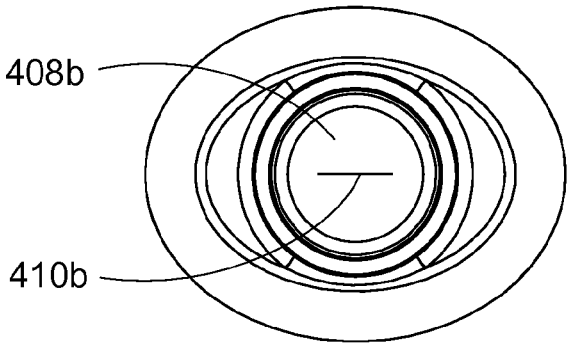
Figure 4C:
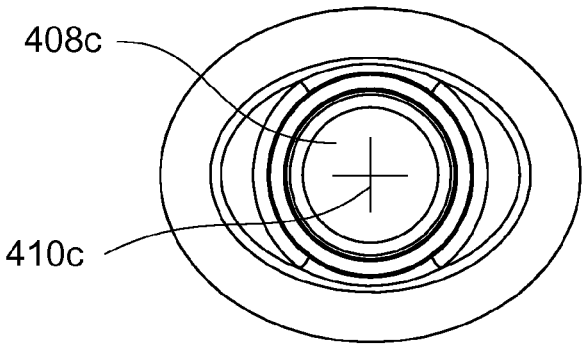

FIGS. 4A, 4B, and 4C are planar top views of three examples of protective spout covers having different regulating valve configurations, including a top membrane 408*a* having a valve aperture 410*a* with a transverse orientation (FIG. 4A), a top membrane 408*b* having a valve aperture 410*b* with a longitudinal orientation (FIG. 4B), and a top membrane 408*c* having a valve aperture 410*c* with both transverse and longitudinal elements (FIG. 4C), in accordance with various embodiments. One of skill in the art will appreciate that a number of valve variables may be changed in order to increase or decrease the rate of flow through the valve aperture, such as increasing or decreasing the thickness or durometer hardness of the top membrane and/or sidewall of the upper valve portion, increasing or decreasing the concavity of the valve membrane, or changing the size, shape, and/or orientation of the valve aperture within the top membrane. One of skill in the art will appreciate that the protective spout covers disclosed herein may have certain measurable functional properties, such as the ability within withstand certain pressures while still retaining the pouch contents within the pouch. For example, various valves may be optimized to withstand a pressure of 0.2-2 pounds per square inch before releasing the pouch contents. In other embodiments, the valve may be configured to retain water within the pouch while resisting a certain amount of pressure, such as 0.2-2 pounds per square inch.

Figure 5A:
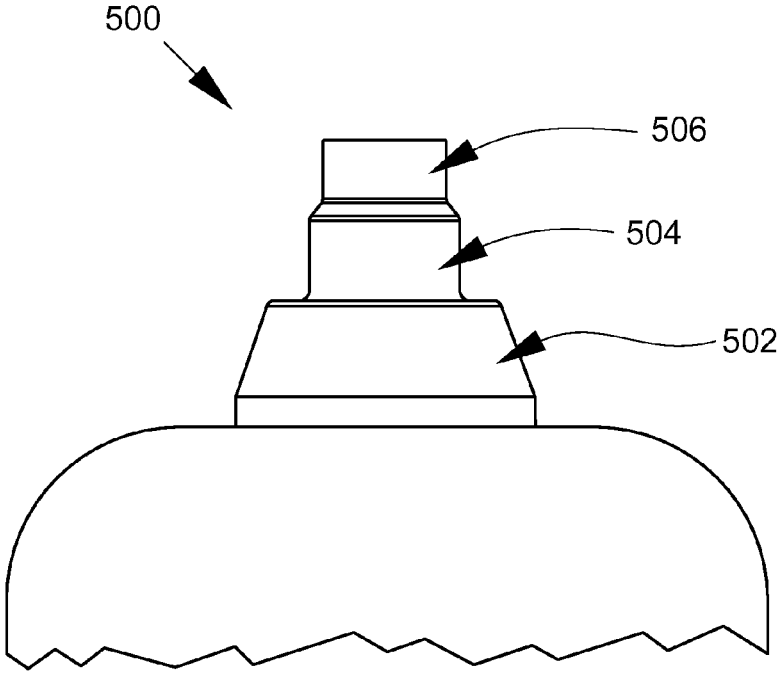
FIGS. 5A and 5B include a transparent planar side view (FIG. 5A) and a cross sectional view (FIG. 5B) of one example of a protective spout cover attached to the spout of a baby food pouch, in accordance with various embodiments.
Figure 5B:
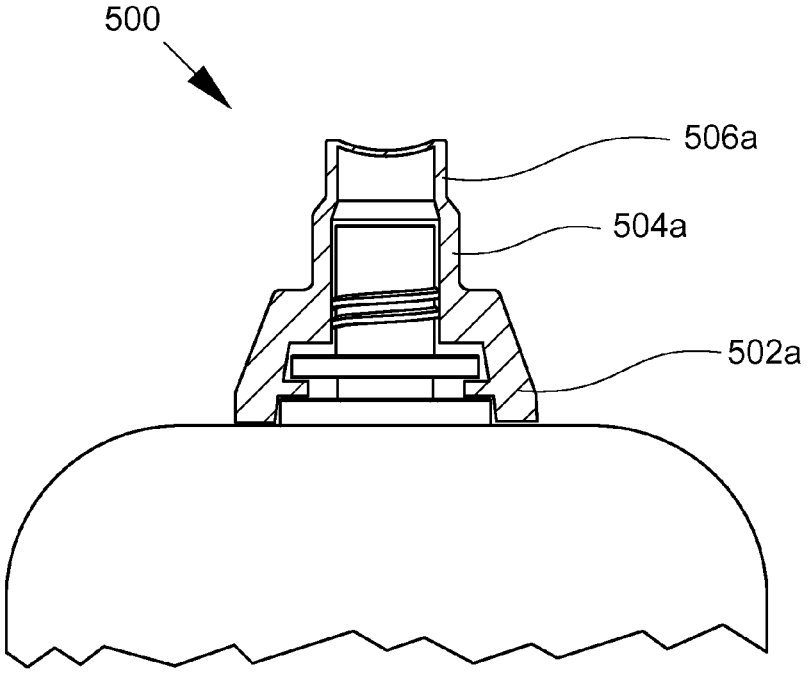

FIGS. 5A and 5B include a transparent planar side view (FIG. 5A) and a cross sectional view (FIG. 5B) of one example of a protective spout cover 500 attached to the spout of a baby food pouch, in accordance with various embodiments. The spatial relationships between the upper valve portion 506, spout cushioning portion 504, and lower gripping portion 502 can be seen in FIG. 5A, and the relationships between the corresponding sidewalls 506*a*, 504*a*, and 502*a* can be seen in FIG. 5B. In some embodiments, protective spout cover 500 may be used with other food pouch spouts having different profiles. One of skill in the art will appreciate that the positioning and proportions of lower gripping portion 502 (and the corresponding gripping features, such as the inner gripping lips) may be spaced, sized, or positioned in other ways in order to securely grip the contours of other spouts. Additionally, one of skill in the art will appreciate that the thickness and/or durometer hardness of lower gripping portion 502 may be varied in order to provide a protective spout cover that may withstand a predetermined amount of force before releasing its grip on the spout. For instance, the protective spout cover may be configured to withstand about 2-10 pounds per square inch of pressure without releasing the spout, such as about 3, 4, 5, or 6 pounds per square inch. One of skill in the art will appreciate that such gripping forces may increase the safety of the protective spout cover in use, by preventing accidental release from the spout when being used by a baby or young child.

Figure 6A:
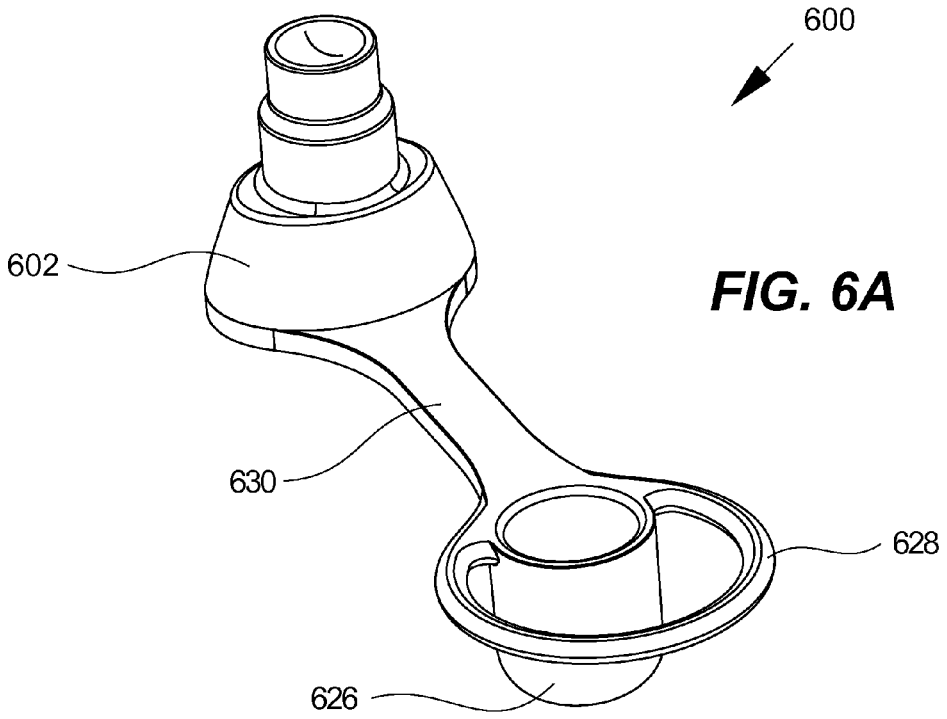
FIGS. 6A and 6B include a perspective view (FIG. 6A) and a cross sectional view (FIG. 6B) of an example of a protective spout cover that includes a cap member with a gripping ring attachment, in accordance with various embodiments.
Figure 6B:
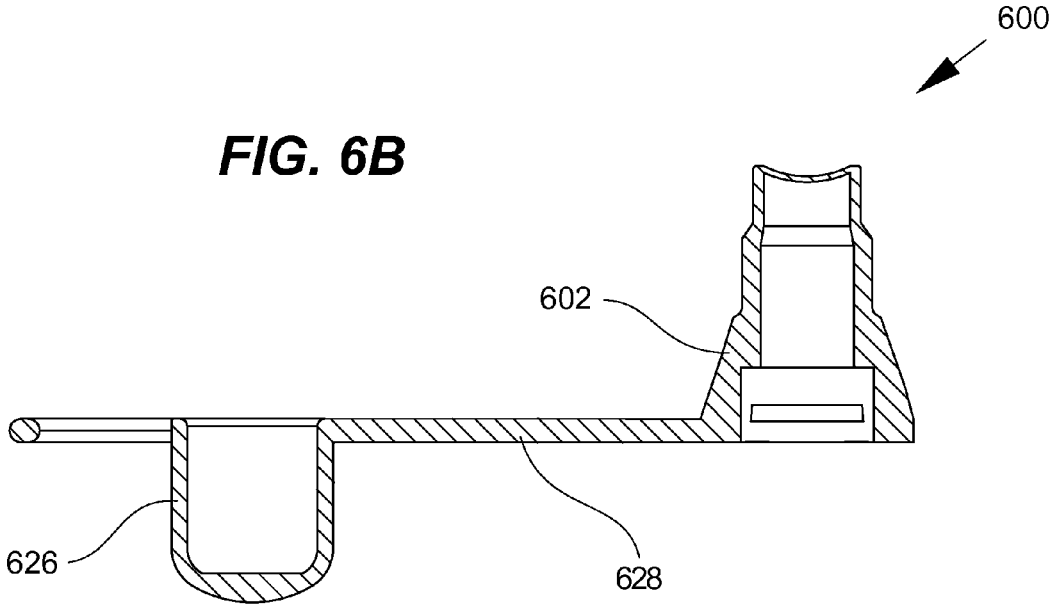

FIGS. 6A and 6B include a perspective view (FIG. 6A) and a cross sectional view (FIG. 6B) of an example of a protective spout cover that includes a cap member with a gripping ring attachment, in accordance with various embodiments. As shown in FIGS. 6A and 6B, in various embodiments, the protective spout cover 600 may include a cap member 626 that fits snugly over the upper valve portion and/or spout cushioning portion, leaving the lower gripping portion 602 uncovered. In various embodiments, cap member 626 may be tethered to lower gripping portion by a flexible tether 630 that may flex to allow cap member 626 to be coupled to the upper valve portion and/or spout cushioning portion and may protect and keep these structures clean when protective spout cover 600 is not in use.

Additionally, cap member 626 may prevent accidental spilling of the pouch contents when not in use. In the illustrated embodiment, cap member 626 includes a gripping ring 628 that facilitates use of cap member 626. In various embodiments, the entire protective spout cover 600, including the flexible tether, cap member, and gripping ring may be made from a single, unitary piece of elastomer, and may include no small parts that could be removed by a child and pose a choking hazard. In various embodiments, when cap member 626 is uncoupled from upper valve portion 606 and spout cushioning portion 604, flexible tether 630 may project away from lower gripping portion 602, maintaining cap member 626 and gripping ring 628 in a position out of the way of the user. Although gripping ring 628 is illustrated as a ring shaped member extending from cap member 626, one of skill in the art will appreciate that gripping ring 628 may assume other forms, such as a pull tab, ledge, or the like.

Figure 7C:
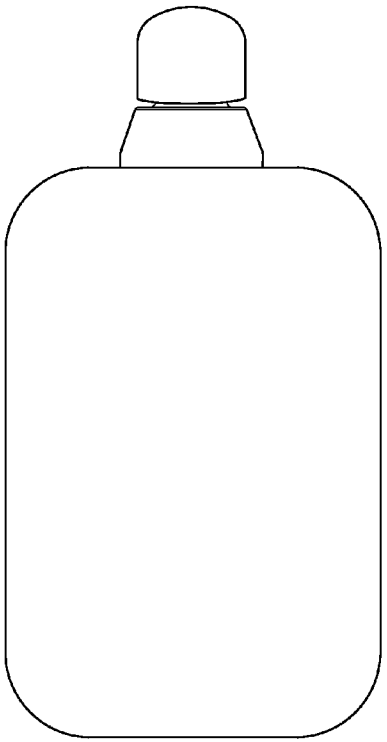
FIGS. 7A, 7B, and 7C show three embodiments of images of a protective spout cover used in conjunction with a baby food pouch, including an embodiment wherein the gripping ring is shown securing the protective spout cover to an unopened baby food pouch (FIG. 7A), an embodiment wherein the protective spout cover is coupled to a baby food pouch spout with the cap member covering the upper valve portion (FIG. 7B), and an embodiment without a gripping ring (FIG. 7C), all in accordance with various embodiments.
Figure 7B:
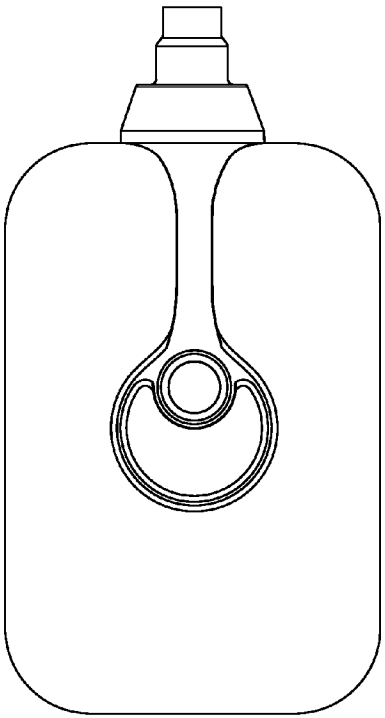
Figure 7A:
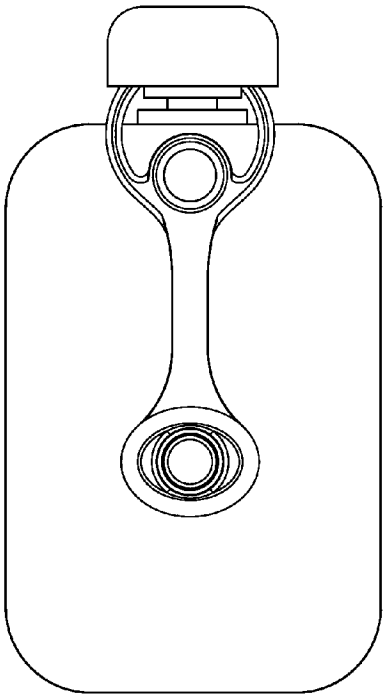

FIGS. 7A, 7B, and 7C show three embodiments of images of a protective spout cover used in conjunction with a baby food pouch, including an embodiment wherein the gripping ring is shown securing the protective spout cover to an unopened baby food pouch (FIG. 7A), an embodiment wherein the protective spout cover is coupled to a baby food pouch spout with the cap member in an open position (FIG. 7B), and an embodiment without a gripping ring, with the cap member in a closed position (FIG. 7C), all in accordance with various embodiments.

In various embodiments, in use, the aperture in the base of the lower gripping portion of the protective spout cover may be placed over the universal spout of a food pouch, and downward pressure may be applied to the protective spout cover until the universal spout slips into the inner diameter of the spout cushioning portion. At the same time, the annular inner gripping lip (or opposing pair of inner gripping lips) may slide into an exterior groove at the base of the universal spout, locking the protective spout cover tightly onto the universal spout and preventing accidental removal.

In various embodiments, audible or tactile feedback may be produced when the inner gripping lips slide into the exterior groove of the universal spout, allowing a parent or caretaker to verify that the protective spout cover has been securely coupled to the universal spout. In various embodiments, the sidewall of the lower gripping portion may be sufficiently thick and rigid to retain the inner gripping lips in the external groove of the universal spout until the protective spout cover is forcibly removed by a parent or other caretaker. Additionally, in the event of accidental release from the universal spout, the sidewall of the lower gripping portion also may be sufficiently rigid and thick to prevent the protective spout cover from folding or collapsing in on itself. In various embodiments, such folding or collapsing could be dangerous, as it could allow the device to be compressed to a size that could fit within the windpipe of a child and cause a choking hazard. Thus, the firmness and thickness of the sidewall of the lower gripping portion of the device helps increase the safety of a young user.

Although certain embodiments have been illustrated and described herein for purposes of description of the preferred embodiment, it will be appreciated by those of ordinary skill in the art that a wide variety of alternate and/or equivalent embodiments or implementations calculated to achieve the same purposes may be substituted for the embodiments illustrated and described without departing from the scope of the present disclosure. Those with skill in the art will readily appreciate that embodiments in accordance with the present disclosure may be implemented in a very wide variety of ways. This application is intended to cover any adaptations or variations of the embodiments discussed herein. Therefore, it is manifestly intended that embodiments in accordance with the present disclosure be limited only by the claims and the equivalents thereof.

What is claimed is:

1. A protective spout cover configured for sealing engagement with a spout on a food pouch, the protective spout cover comprising:

a unitary elastomeric member having an upper end, a lower end, and a sidewall defining a generally cylindrical lumen extending therethrough and having an outer surface and an inner surface, the unitary elastomeric member further comprising:

a gripping portion having a first sidewall thickness and comprising a portion of the lumen sized and shaped to receive, grip, and sealingly engage an exterior surface of the spout; and a valve portion disposed adjacent the upper end, the valve portion having a second sidewall thickness and comprising a valve configured to control a flow of food from the food pouch;

wherein the first sidewall thickness is different from the second sidewall thickness.

2. The protective spout cover of claim 1, wherein the gripping portion is disposed adjacent the lower end.

3. The protective spout cover of claim 1, wherein the gripping portion is sized and shaped to receive, grip, and sealingly engage a threaded exterior surface of the spout.

4. The protective spout cover of claim 1, wherein the inner surface comprises an inward-projecting gripping lip adapted to engage and grip a corresponding groove on the exterior surface of the spout.

5. The protective spout cover of claim 4, wherein the inward-projecting gripping lip portion is sized and shaped to receive, grip, and sealingly engage a threaded exterior surface of the spout.

6. The protective spout cover of claim 1, wherein the unitary elastomeric member further comprises a spout cushioning portion disposed between the gripping portion and the valve portion, the spout cushioning portion having a third sidewall thickness, wherein the first, second, and third sidewall thicknesses are all different.

7. The protective spout cover of claim 1, wherein the elastomer comprises silicone.

8. The protective spout cover of claim 1, wherein the elastomer consists of silicone.

9. The protective spout cover of claim 1, wherein the elastomer comprises natural or synthetic rubber.

10. The protective spout cover of claim 1, wherein the elastomer has a durometer hardness of from about 50 to about 80 Shore A.

11. The protective spout cover of claim 1, wherein the elastomer has a durometer hardness of about 55 Shore A.

12. The protective spout cover of claim 1, wherein the inner surface comprises a pair of inward-projecting gripping lips disposed on opposite sides of the lumen.

13. The protective spout cover of claim 1, wherein a force of at least 4 pounds per square inch is required to remove the protective spout cover from the universal spout.

14. The protective spout cover of claim 1, wherein the valve portion comprises a top membrane disposed at the upper end.

15. The protective spout cover of claim 14, wherein the top membrane is concave.

16. The protective spout cover of claim 15, wherein the top membrane comprises a valve aperture.

17. The protective spout cover of claim 1, further comprising a cap member adapted to cover and couple to the valve portion, and wherein the cap member extends from the gripping portion via a flexible tether.

18. The protective spout cover of claim 17, wherein the cap member further comprises a gripping ring.

19. The protective spout cover of claim 1, wherein at least a portion of the unitary elastomeric member has an outer diameter that is sufficiently large to prevent choking.

20. The protective spout cover of claim 1, wherein at least a portion of the unitary elastomeric member has an outer diameter of greater than 1.25 inches.

* * * * *